United States Patent [19]

Burgess et al.

[11] 3,979,920

[45] Sept. 14, 1976

[54] SEALING MEANS

[75] Inventors: Roy Patrick Burgess, Tunbridge Wells; Alan James Cox, Rochester, both of England

[73] Assignee: National Research Development Corporation, London, England

[22] Filed: Dec. 30, 1974

[21] Appl. No.: 537,320

Related U.S. Application Data

[63] Continuation of Ser. No. 312,868, Dec. 7, 1972, abandoned.

[52] U.S. Cl. ..... 61/84; 61/42

[51] Int. Cl.[2] ..... E01G 5/16

[58] Field of Search ..... 61/84, 85, 42, 45; 49/475; 299/31, 33

[56] References Cited

UNITED STATES PATENTS

| | | | |
|---|---|---|---|
| 734,265 | 7/1903 | Hough | 61/85 |
| 1,296,312 | 3/1919 | O'Rourke | 61/85 |
| 3,002,253 | 10/1961 | Kessler | 49/475 X |
| 3,410,098 | 11/1968 | Winberg | 61/85 |
| 3,494,136 | 2/1970 | Wilms | 61/85 |
| 3,616,137 | 10/1971 | Horton | 49/475 X |
| 3,788,087 | 1/1974 | Patin | 61/85 |

FOREIGN PATENTS OR APPLICATIONS

| | | | |
|---|---|---|---|
| 1,197,914 | 8/1965 | Germany | 61/85 |
| 1,290,943 | 3/1969 | Germany | 61/85 |
| 1,534,625 | 7/1969 | Germany | 61/85 |

*Primary Examiner*—Dennis L. Taylor
*Attorney, Agent, or Firm*—Cushman, Darby & Cushman

[57] ABSTRACT

A sealing means is provided for sealing against passage of liquid between two surfaces, as between the tail-piece of a tunnelling machine and the tunnel lining to prevent ingress of working liquid into the tunnel workings, said sealing means comprising a mount for flexible fibers projecting brush-like therefrom, the mount being fixed in substantially liquid-tight manner to one said surface, such as that of a tail-piece, and arranged to permit said fibers to extend into contact with the second surface, such as that of the tunnel lining. The free ends of at least a portion of the fibers preferably extend parallel with the second surface and in contact with one another and/or that surface. Flexible sheeting may be arranged in combination with the fibers substantially to close off said space and inflatable air-bag means may be interposed between the free ends of the fibers (fiber/sheeting combination) and the first surface to increase the pressure of contact between the fibers and the first surface.

15 Claims, 6 Drawing Figures

SEALING MEANS

This is a continuation of application Ser. No. 312,868 filed Dec. 7, 1972, now abandoned.

This invention relates to sealing means and has particular reference to tunneling apparatus. It is described herein as being concerned principally with apparatus for driving a tunnel passageway or the like horizontally; while the following description is concentrated on horizontal tunnels, it will be appreciated that the invention may also be applicable to shaft sinking and the like apparatus. It will also be appreciated that the invention is applicable also to analogous apparatus when requirements for similar sealing means arise.

In U.K. Patent Specification No. 1083322 there is disclosed a method of tunnelling which is particularly applicable where the working face is not self-supporting, for example where the tunnel has to be driven into loose gravel or the like. That method involves the use of a liquid thixotropic suspension and requires the provision of a machine which includes a shield having a bulkhead in front of which a power driven rotary mechanical digging device operates, the suspension being delivered, suitably pressurised, to the space in front of this bulkhead.

As a result of its thixotropic properties the suspension will be relatively free-flowing and can be pumped into the working space at the front of the bulkhead but, having reached or penetrated partly into the working face, it will become substantially solid, or semi-solid, or viscous and will thus materially assist in supporting the face or forming, in effect, a pressure membrane on or in the ground, against which the pressure of the liquid suspension in the working chamber acts.

This suspension may consist of, or contain, mud and its thixotropic properites may be provided by the use of bentonite. It is preferred that the digging device will excavate the working face to enable the shield to be moved forward substantially without circumferential interference from the wall of the excavation and in consequence the material at the face will be removed by the digging device to substantially the external diameter of the shield. This can result in passage of some of the pressurized suspension around the outside of the shield and thence into the tunnel. Another possibility with this type of apparatus is that of grouting material finding its way along the passage around the outside of the tunnel lining, again into the tunnel workings. Grout will usually be fed to the outside of the tunnel lining section after addition to the previously installed portion of the lining — however grouting procedures are well known and need not be described herein.

The present invention is directed to the provision of means which should at least diminish the passage of such materials into the tunnel workings but which could possibly prevent it altogether.

In one form of tunnelling shield of the kind described above, there is provision for assembly of the tunnel lining segments within the shield so that each succeeding segment is bolted or otherwise secured and sealed to the preceding segment of the tunnel lining when the shield is advanced by an appropriate distance. Other forms of lining are known, of course, particularly those where the extension made possible by further excavation is formed directly on the end of the completed portion of tunnel. In any event it is usually the case that the tail of the tunnelling shield overlaps the tunnel lining by a small amount. In this way it becomes possible for a seal to be established between the tail piece and the outer wall of the lining to counteract flow of suspension or grout or the like. Alternatively it may be possible to arrange to seal the gap between the tail piece and the wall of the excavation to seal against passage of suspension.

A sealing means for sealing passage of a liquid, such as a liquid thixotropic suspension, between two surfaces, in accordance with the invention, comprises a mount for flexible fibres projecting brush-like therefrom, said mount being fixed in substantially liquid-tight manner to one of the surfaces so as to permit the free ends of the fibres to extend in such a way as to enable at least a portion of them to engage with the second surface. The flexibility of the fibres enables the seal very effectively to take up any differences in size of the space to be sealed and as well to take up any irregularities in the shape of the second surface. Preferably said fibres are not arranged to project in a direction normal to both surfaces, that is, it is preferred that the fibres should lie generally at an angle to one or both of the surfaces with a portion lying substantially parallel to the second surface and in contact with one another and/or with said second surface. The stiffness of the fibres can then be quite high without detracting from flexibility. Additionally, it is preferred that the free ends of the fibres should extend generally in the opposite direction to that in which the liquid is to approach the seal. The fibres in any particular seal will usually be of equal length but, particularly if the space to be sealed is non-uniform, they may be longer or shorter at different parts of the seal, if required.

Proprietary brands of mounted flexible fibres are available in strip form. These comprise polymer fibres, possibly of nylon, of suitable diameter held by one end within a slightly re-entrant channel, the fibre ends being trapped by suitable means; the ends may be held within a cured resin within the channel. If desired, however, the fibres may be metallic, such as steel wires. The finer the fibre then, in general, the greater will be the flexibility, but it will be apparent in any particular application whether the emphasis should be more on the size of the fibre or on stiffness. Obviously the fibres should preferably be resistant to attack by the liquid concerned.

Where, as in the case of the seal for the tail piece of the tunnelling shield as described above, the space to be sealed takes the form of an annulus, it is necessary that the mount should take the curvature of the surfaces to be sealed. One method of forming the seal is to weld the base of the channel of the strip to a chamfer on one side of a bar of length equal to that of the strip, the other side of the bar being relieved to fit a corresponding flange on one of the surfaces. This bar, and with it, of course, the fibre strip, is then rolled to the curvature required to fit the flange. In fact, it may be found to be desirable to fabricate a complete peripheral seal by producing, say, quadrant or other multiple, sections which together form the whole when secured around the surface.

An alternative method of forming a seal is to fabricate a clamp within which the fibre mounting channel is trapped by virtue of its re-entrant form. The channel, and therefore, of course, the clamp may need to be formed to a particular shape, if the space to be sealed is of such shape as to require it.

A sealing arrangement in accordance with the invention may comprise a number of these flexible fibre seals in series. Even so, in particular circumstances, it may be found that the fibres alone are insufficient to give the desired degree of sealing-off of the liquid. In that case, it may be necessary to provide a seal with additional means such as sheeting, possibly incorporated into the structure of the mounted flexible fibres, in order to increase the effectiveness of the seal. The additional means will not normally, however, be such as entirely to override flexibility of the fibres.

It will be evident that the flexibility is such that very good wear characteristics can be achieved.

As an additional precaution, it may be desirable to provide expandable means such as an air bladder to act between the first surface and the fibres to increase the pressure of the fibres against the second surface and/or to reduce the size of the gap to be sealed by the fibres or fibre/sheeting combination.

In order that the invention may be more clearly understood, constructions of seals and sealing arrangements in accordance with this invention will now be described. These particular seals and seal arrangements are proposed in respect, especially, of incorporation into a tunnelling machine in which a thixotropic suspension is used to stabilise the working face, such as that described in U.K. Patent No. 1,083,322.

Figure 1:
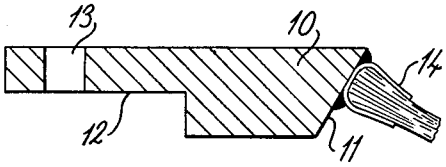
FIGS. 1 and 2 illustrate one form of seal and a method of incorporating it into a tunnelling machine.

FIG. 1 shows a section through a strip mounting bar 10 of which one side is chamfered at 11 and the other side is provided with a milled cut-out 12 for engagement with a flange on the end of the tail piece of the tunnelling shield. The base of the reentrant channel 14, in which flexible fibres 15 are held, is welded against the chamfered edge. Only the fixed end of the 'brush' of fibres is indicated in FIG. 1; the lengths of the fibres will be suitably chosen for the particular space to be sealed. The size and/or flexibility and/or numbers will be chosen, as will be evident, to suit particular requirements. The mounting bar is drilled and tapped for screw fixation, or possibly only drilled for rivetting, at 13 and is subsequently formed by rolling into a section of length one-sixth of the circumference of the tail piece.

Figure 2:
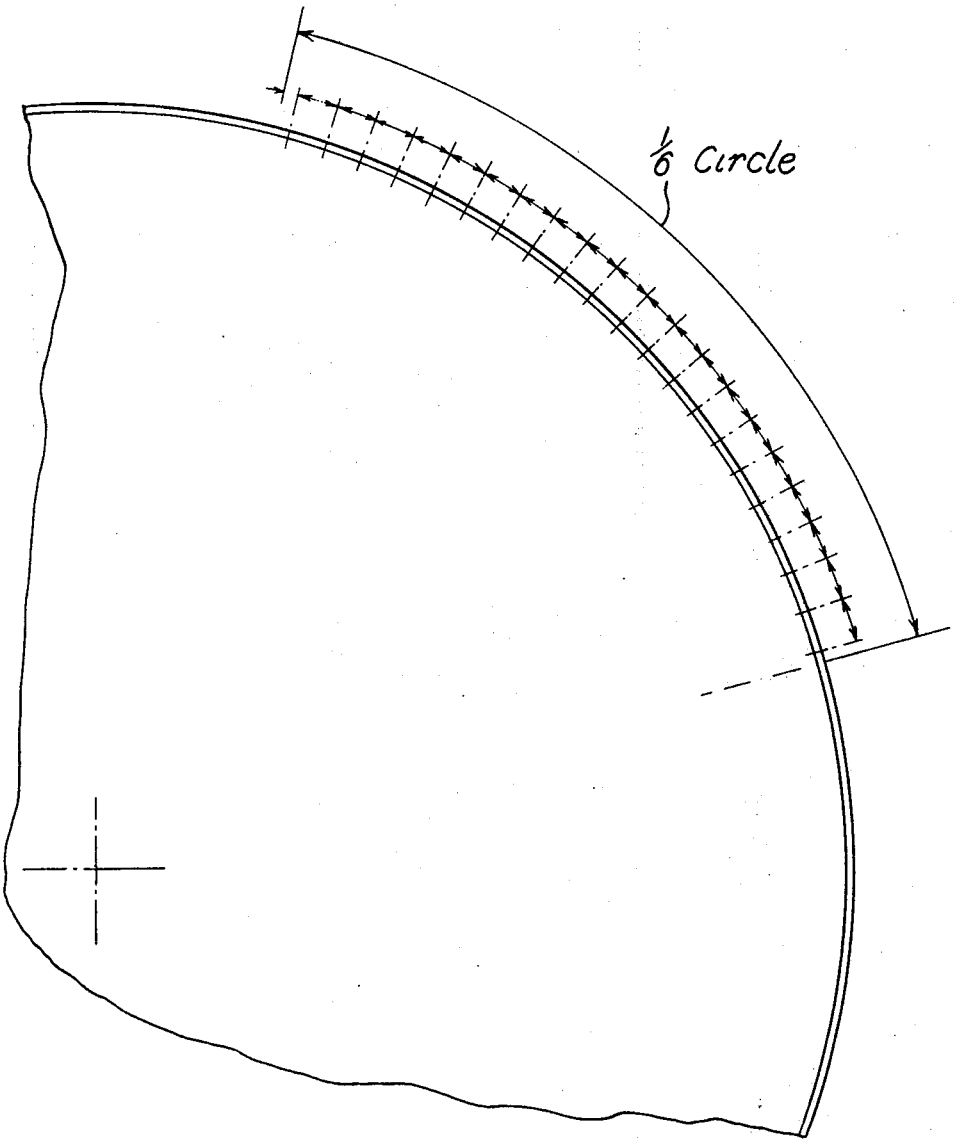

FIG. 2 shows a portion of the rim of the tail piece with complementary holes drilled for fixation of the mounting bar of FIG. 1. Because of the scale of FIG. 2, no attempt has been made to indicate the flange which is machined around the end of the tail piece; the holes are drilled in this flanged portion. The adjacent ends of the mounting bars will be sealed to each other, as, for example, by welding, during or after fixation to the tail piece.

Figure 3:
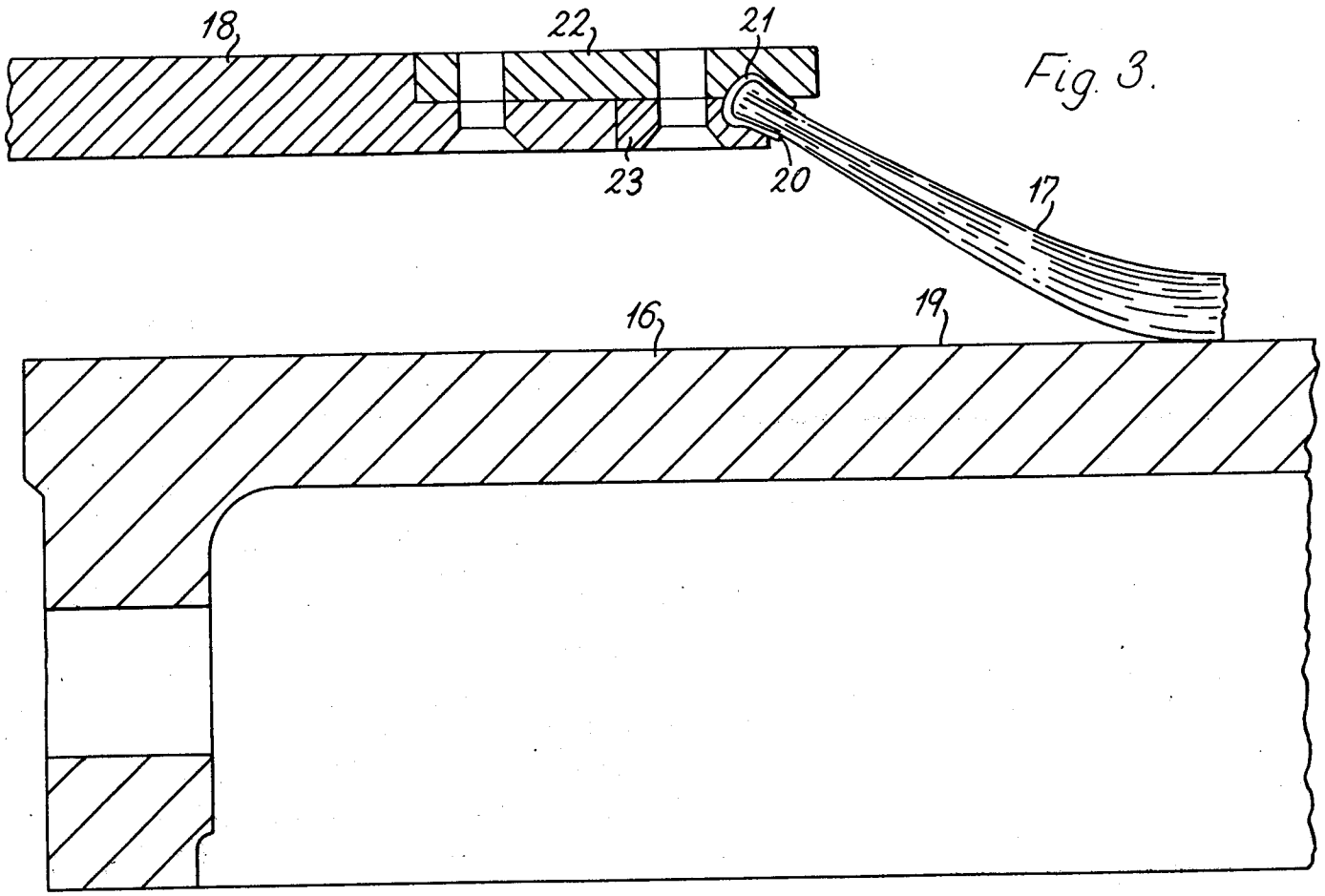

FIG. 3 shows an alternative method of fixing the fibre mount. In that illustration, a tunnel liner segment 16 is also indicated and the relative attitudes of the fibres 17, the tail piece 18, and the wall 19 of the liner segment are illustrated. The fibre mounting channel 20 in this arrangement is trapped within a groove 21 in the mounting bar 22 by a clamp 23 which is rivetted to the mounting bar. The mounting bar is in turn rivetted to the flange part of tail piece.

Figure 4:
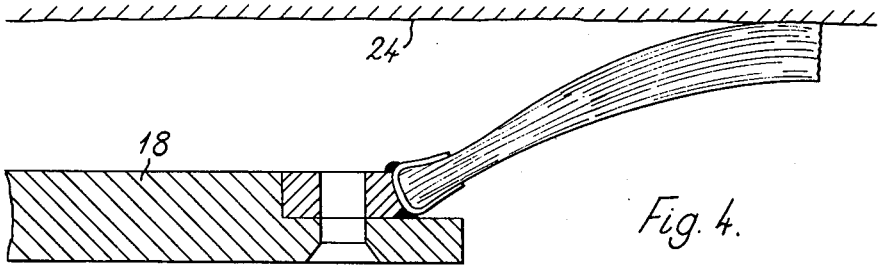
FIGS. 3, 4 and 5 illustrate alternative constructions of seal.
Figure 5:
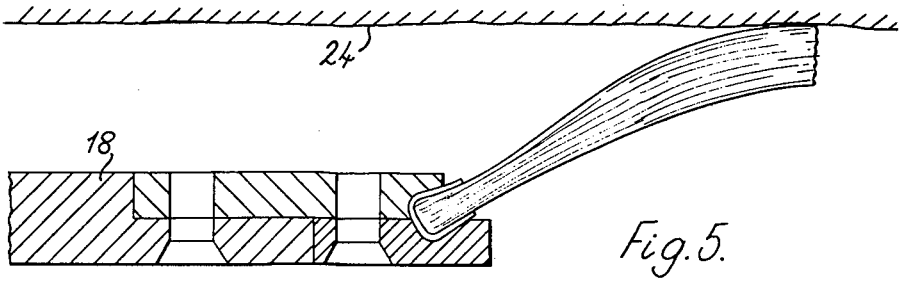

FIGS. 4 and 5 illustrate yet further methods of mounting the fibre strip in position though these do not differ essentially from those of FIGS. 1 and 3 respectively. These illustrations are representative of outwardly extending fibre seals; in these cases the seal is made between the tail piece 18 and the wall 24 of the excavation. It is to be noted also that in the configurations of FIGS. 4 and 5 and in that of FIG. 3, it is necessary to form the fibre holding channel to the correct shape conforming to that of the fixation by which it is to be fixed to the tail piece.

In the type of seal proposed according to the invention it is possible that its success in effectively sealing against leakage may depend upon the volume of fibre presented against the flow of liquid; but, possibly, in the case of a thixotropic suspension, the volume of fibre need only be such as to trap solids of the suspension which could aid the effectiveness of the seal. Fibre diameter and length of fibre will probably be factors affecting operation of the seal but, if necessary, the choice of sizes can be made at the design stage as a result of simple experimentation.

Figure 6:
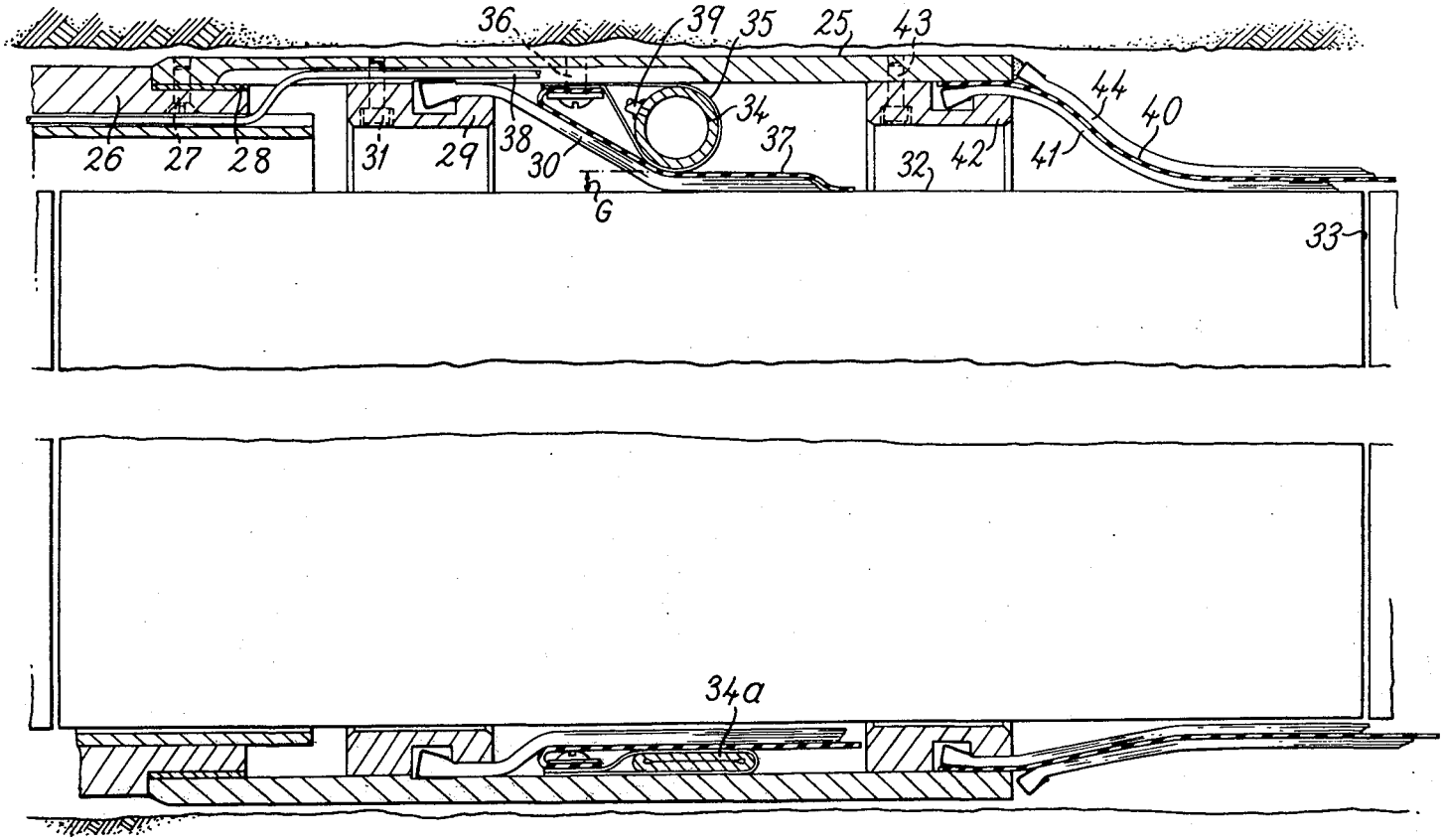
FIG. 6 illustrates a more elaborate design of sealing arrangement.

The arrangement shown in FIG. 6 is intended for use where a simple seal may not be sufficiently effective.

In this arrangement the mounting bar 25 which is secured to the flanged end of the tail piece 26 by screws 27 is much longer than in the seals shown in FIGS. 1, 3, 4 and 5; a packing strip 28 provides a fluid-tight joint with the tailpiece. There are six arcuate bars 25 around the full circumference of the tail piece and adjacent bars are secured to each other in fluid-tight manner. Clamping strips 29 are provided to secure each length of flexible fibre strip 30 to the inside wall of its mounting bar, these being fixed by means of the screws 31.

Between the ring of mounting bars and the wall 32 of the tunnel lining 33 an expandable air bladder in the form of tube 34 is secured by strapping 35 which is itself held by screws 36. The screws 36 also serve to secure a strip of thin rubber sheeting 37 which extends over the outer face of the flexible nylon brush strip 30. The outer end of the sheeting makes direct contact with the wall 32 of the lining. An air-line 38 which is connected to the tube 34 at junction 39 enables the operator to feed compressed air into the tube to expand it so as to cause reaction between the mounting bar 25 and the brush 30 and sheeting 37. This in turn causes the brush to be pressed into contact with the lining wall to effect a seal. It also serves to reduce the actual gap to be sealed to the space between the inner diameter of the tube and the tunnel lining, i.e. the space marked "G". The air pressure in the tube can be adjusted as desired. Here the wear characteristics of the nylon fibre is obviously better than could be achieved with pressurized contact between the sheeting 37 and the wall of the lining, especially as its sealing contact with the wall must allow of movement of the seal along the wall. In the absence of the fibre, such thin sheeting could not be used without constant necessity for replacement due to wear; and a thicker rubber sheeting would not have the same advantageous flexibility as the thin sheeting combined with the fibre.

A second seal is shown at the outer end of the mounting bar, this seal comprising rubber sheeting 40 in combination with the brush 41, the sheeting and brush being secured to the mounting bar by means of clamping strips 42 and screws 43. In order to maintain the sheeting 40 in place a further brush 44 is secured to the end of the mounting bar as shown, such as by welding, so that the sheeting is sandwiched between the two brushes. The brush 44 is mounted in such position that the fibres press against the sheeting 40 in virtue of their stiffness.

The arrangements of FIG. 6 show that a seal is made between the tail piece of the tunnelling machine and the part of the tunnel lining already installed so as to act to prevent working or other fluid which collects outside the shield and tunnel lining from entering the tunnel workings between the tail of the shield and the end of the tunnel lining.

FIG. 6 illustrates the possible conditions which may apply if the tunnel lining does not happen to be concentric with the tunnelling machine. Thus allowance should be made for the extreme position where the bottom of the lining rests against the clamping strips 29 and 42, with the result that the tube 34 is squashed flat at the bottom point as shown at 34*a*. This means that the gap at the top is greater than it would be if the lining were concentric with the ring of mounting bars and this will affect the length of the fibres of the brushes 30, 41 and 44 and also of the sheeting 37 and 40 as it will be evident that if these are too short it would be impossible for part of the fibres to extend along the wall of the lining. This point of concentricity has also to be watched when a seal is desired to be made between the tail piece and the wall of the excavated tunnel.

It will be appreciated that the above descriptions of particular designs and arrangements are given only by way of example and that the seal of the invention is capable of further modification and adaptation.

We claim:

1. Sealing means for sealing passage of pressurized liquid between two surfaces comprising, flexible fibres, a mount for said fibres from which the fibres project in brush-like form, each fibre following substantially the same direction, said mount being fixed in substantially liquid-tight manner to one of said surfaces and arranged to permit said fibres to extend generally at an angle substantially less than 90° to at least said first surface, with a portion of the fibres lying substantially parallel to said second surface and said fibres being in contact with each other with a portion thereof contacting said second surface, the seal thus bridging the gap between said two surfaces.

2. Sealing means as claimed in claim 1 wherein said fibres are arranged to extend generally from said first surface in a direction opposite to the direction taken by the liquid in approaching the seal.

3. Sealing means as claimed in claim 1 wherein the fibres are of substantially equal length.

4. Sealing means as claimed in claim 1, wherein said fibres are polymer fibres.

5. Sealing means as claimed in claim 4, wherein said fibres are nylon fibres.

6. Sealing means as claimed in claim 1, comprising in addition inflatable air bladder means arranged between free ends of said fibres and said first surface.

7. Sealing means as claimed in claim 6 wherein means are provided for adjustment of the pressure of inflation of said air bladder means.

8. Sealing means as claimed in claim 1, comprising in addition inflatable air bladder means arranged between flexible sheeting and said first surface, said bladder means thereby being arranged to press said fibres against said second surface.

9. Sealing means as claimed in claim 8 wherein means are provided for adjustment of the pressure of inflation of said air bladder means.

10. In a tunnelling machine of the type in which a pressurized liquid is used in front of a bulkhead on a shield and in which the tail-piece of the shield overhangs an installed tunnel lining, the improvement comprising the provision of a seal against leakage of said liquid into the tunnel workings through the space between the tail-piece and the lining, said space being non-uniform about said tail-piece and said lining, said seal comprising flexible elongated fibres, a mount for said fibres from which the fibres project in brush-like form, each fibre following substantially the same direction, said mount being fixed to the tail-piece in a substantially fluid-tight manner and arranged to permit said fibres to extend generally at an angle substantially less than 90° to the surface of the tail-piece, with a portion of the fibres lying substantially parallel to the outer wall of the tunnel lining and in close contact with each other, portions of the fibres contacting said tunnel lining, the seal bridging the gap between said tail-piece and said tunnel lining.

11. A tunnelling machine as claimed in claim 10, wherein said fibres are arranged to extend generally from the tail-piece in a direction opposite to that taken by the liquid in approaching the seal.

12. A tunnelling machine as claimed in claim 10, wherein flexible sheeting is arranged in combination with said fibres to extend substantially across the space between the tail-piece and the tunnel lining.

13. A tunnelling machine as claimed in claim 12, wherein inflatable air bladder means is arranged between the tail-piece and the flexible sheeting in the vicinity of the free ends of the fibres whereby to cause pressure of the fibres against the lining wall.

14. In a tunnelling machine of the type in which a pressurized thixotropic fluid is used in front of a bulkhead on a shield in which the tail-piece of the shield overhangs an installed tunnel lining, the improvement comprising the provision of a seal against leakage of said liquid into the tunnel workings through the space between the tail-piece and the lining, said space being non-uniform about said tail-piece and said lining, said seal comprising flexible fibers, a mount for said fibers from which the fibers project in a brush-like form, said mount being fixed to the tail-piece in a substantially fluid-tight manner and arranged to permit said fibers to extend generally at an angle substantially less than 90° to at least the surface of the tail-piece, with a portion of the fibers lying substantially parallel to the outer wall of the tunnel lining and in contact with each other, a portion thereof contacting said tunnel lining wherein said fibers trap the thixotropic fluid to thereby increase the effectiveness of said seal.

15. In a tunnelling machine of the type in which a pressurized liquid is used in front of a bulkhead on a shield and in which the tail-piece of the shield overhangs an installed tunnel lining, the improvement comprising the provision of a seal against leakage of said liquid into the tunnel workings through the space between the tail-piece and the lining, said space being non-uniform about said tail-piece and said lining, said seal comprising flexible fibers, a mount for said fibers from which the fibers project in a brush-like form, said mount being fixed to the tail-piece in a substantially fluid-tight manner and arranged to permit said fibers to extend generally at an angle substantially less than 90° to at least the surface of the tail-piece with a portion of the fibers lying substantially parallel to the outer wall of the lining and in contact with each other, a portion thereof contacting said tunnel lining.

* * * * *

UNITED STATES PATENT OFFICE

CERTIFICATE OF CORRECTION

PATENT NO. : 3,979,920

DATED : September 14, 1976

INVENTOR(S) Roy Patrick Burgess & Alan James Cox

It is certified that error appears in the above-identified patent and that said Letters Patent are hereby corrected as shown below:

IN THE HEADING:

Please add:

[30] Foreign Application Priority Data

December 13, 1971 Great Britain.....57851/71

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*